United States Patent [19]

Squire

[11] Patent Number: 5,072,594

[45] Date of Patent: Dec. 17, 1991

[54] METHOD AND APPARATUS FOR PASSIVE REFRIGERANT RETRIEVAL AND STORAGE

[76] Inventor: David C. Squire, 1603 Chestnut, Port Huron, Mich. 48060

[21] Appl. No.: 593,689

[22] Filed: Oct. 5, 1990

[51] Int. Cl.[5] ..... F25B 45/00

[52] U.S. Cl. ..... 62/77; 62/292; 62/149

[58] Field of Search ..... 62/149, 292, 474, 529, 62/77, 85

[56] References Cited

U.S. PATENT DOCUMENTS

| | | | |
|---|---|---|---|
| 3,232,070 | 2/1966 | Sparano . | |
| 4,285,206 | 8/1981 | Koser . | |
| 4,363,222 | 12/1982 | Cain . | |
| 4,364,236 | 12/1982 | Lower et al. . | |
| 4,441,330 | 4/1984 | Lower et al. . | |
| 4,476,688 | 10/1984 | Goddard . | |
| 4,480,446 | 11/1984 | Margulefsky et al. . | |
| 4,539,817 | 9/1985 | Staggs et al. . | |
| 4,646,527 | 3/1987 | Taylor . | |
| 4,766,733 | 8/1988 | Scuderi . | |
| 4,768,347 | 9/1988 | Manz et al. . | |
| 4,809,520 | 3/1989 | Manz et al. . | |
| 4,856,289 | 8/1989 | Lofland . | |
| 4,903,499 | 2/1990 | Merritt . | |
| 4,909,042 | 3/1990 | Proctor et al. . | |
| 4,939,903 | 7/1990 | Goddard . | |
| 4,942,741 | 7/1990 | Hancock et al. | 62/474 |
| 4,967,570 | 11/1990 | Van Steenburgh, Jr. . | |
| 5,018,361 | 5/1991 | Kroll et al. | 62/292 |

FOREIGN PATENT DOCUMENTS

| | | |
|---|---|---|
| WO8100756 | 3/1981 | Int'l Pat. Institute . |
| WO8903963 | 5/1989 | Int'l Pat. Institute . |
| 193567 | 8/1989 | Japan . |
| 225874 | 9/1989 | Japan . |
| 251597 | 10/1970 | U.S.S.R. . |

*Primary Examiner*—Albert J. Makay
*Assistant Examiner*—John Sollecito
*Attorney, Agent, or Firm*—Harness, Dickey & Pierce

[57] ABSTRACT

A passive refrigerant retrieval and storage apparatus is shown for retrieving refrigerant from a cooling system prior to servicing the cooling system. The passive apparatus includes a coil collector tube for the refrigerant contained within an insulated housing with an outlet from the collector tube passing through a metering valve into the housing. The collector tube is connected to the condenser outlet of a cooling system and the system compressor operated to pump pressurized liquid refrigerant into the collector tube. A small portion of the refrigerant is discharged through the metering valve into the apparatus housing where it is evaporated and causes extreme subcooling to the refrigerant in the collector tube. The refrigerant that is not evaporated is trapped within the evaporator housing. A return line from the housing to the inlet side of the compressor returns the evaporated refrigerant to the cooling system. Gradually the cooling system is starved for refrigerant such that the pressures in both the high pressure side and low pressure side of the cooling system gradually decrease, decreasing the pressure of refrigerant within the collector tube of the retrieval apparatus.

16 Claims, 1 Drawing Sheet

METHOD AND APPARATUS FOR PASSIVE REFRIGERANT RETRIEVAL AND STORAGE

BACKGROUND AND SUMMARY OF THE INVENTION

The present invention relates to a method and apparatus for retrieving and storing a refrigerant while servicing a cooling or heat pump system and in particular to a passive retrieval and storage apparatus.

It is widely believed today that the refrigerants, typically chlorofluorocarbons (CFC's) and HCFC's, used in vapor compression cooling and heat pump systems have a detrimental effect on the earths' atmospheric ozone layer when the refrigerant is released from the cooling system. When repairing a cooling system, it is often necessary to first remove the refrigerant from the cooling system. The refrigerant can either be released to the atmosphere or it can be recovered for later reuse in the same equipment, or subsequent processing and reuse. Because of the harmful effects associated with releasing the refrigerant to the atmosphere, in recent years several devices have been developed to retrieve the refrigerant from a cooling system before it is serviced. Many of these devices, in addition to retrieving the refrigerant, also purify the refrigerant so that the refrigerant can be used to recharge the cooling system after the necessary repairs have been made.

Many of these refrigerant retrieval systems include several components typically found in cooling systems such as a compressor, condenser and evaporator. The compressor is generally used to draw the refrigerant from the cooling system into the retrieval system where it is condensed, purified and stored for later reuse are pumped back into the system being serviced. Such systems are relatively expensive and can also be difficult to transport to the job site when making a service call to repair a cooling system. For a service company having a fleet of service trucks, to equip each truck with such a recovery system can be very expensive and space consuming. The expense and transport of the recovery system may not be justified by the cost savings from reusing the refrigerant and may outweigh a desire to avoid environmental damage. As a result, many appliance repairmen may not bother to recover refrigerant from cooling systems.

Accordingly, it is an object of the present invention to provide a simplified apparatus for refrigerant retrieval that can be easily transported to the cooling system being repaired and which is less expensive than the large retrieval systems currently in use that include a compressor.

It is a feature of the retrieval and storage apparatus of the present invention to utilize the compressor of the cooling system being repaired in the retrieval process rather than including a compressor in the retrieval apparatus. The system of this invention many also be employed in conjunction with an auxiliary compressor in conditions of failure of the serviced system compressor.

The apparatus of the present invention includes a coiled collector tube for receiving pressurized liquid refrigerant from the cooling system. The collector tube is contained within a well insulated evaporator housing. One end of the collector tube is connected to the high pressure side of the cooling system to receive pressurized liquid refrigerant from the condenser. The other end of the collector tube includes an adjustable metering valve leading to a refrigerant outlet that discharges refrigerant from the collector tube into the evaporator housing. The interior of the housing is connected to the low pressure side, or inlet side, of the compressor of the cooling system to draw refrigerant into the compressor. The existing services ports on the cooling system are the connection points.

In operation, the cooling system compressor is activated to pump condensed pressurized liquid refrigerant into both the system evaporator and the collector tube which is now functioning as a parallel evaporator. As the refrigerant passes through the metering valve into the evaporator housing, the refrigerant will flash causing the available heat to be removed within the evaporator housing. The temperature within the housing will decrease to a point where there is not enough available heat to evaporate all the liquid refrigerant entering the evaporator housing. At this point only a small portion of the refrigerant is now flashed since the only heat available is what is introduced into the evaporator housing by the sensible heat being given off from the collector tube. The warm liquid refrigerant within the collector tube is now undergoing extreme subcooling. Since the entering liquid refrigerant that does not evaporate has already been cooled to about the same temperature as the evaporator housing, it is relatively stable and will begin to collect in the bottom of the evaporator housing. It is now trapped there due to the limited heat available within it's environment.

The evaporated refrigerant picks up heat from the collector tube, as it is pulled from the evaporator housing through the outlet back into the compressor where it is pressurized and later condensed and returned to the collector tube. As the cold liquid refrigerant is trapped in the collector tube, the system pressures generated by the compressor will gradually decrease as less refrigerant becomes available for the compressor to displace. When the quantity of refrigerant leaving the device equals the quantity of refrigerant entering the device, the exit valve is closed. The compressor continues to run forcing the refrigerant gas left in the system into the collector where much of it will condense because of the cool environment that has been created in the evaporator housing. When the internal temperature of the device has risen to where no more condensation is possible, the inlet valve of the retrieval apparatus is closed and the equipment can be repaired and the refrigerant reused, or the device can be transported to a station for recycling the refrigerant.

Further objects, features and advantages of the invention will become apparent from a consideration of the following description and the appended claims when taken in connection with the accompanying drawings.

DETAILED DESCRIPTION OF THE INVENTION

Figure 1:
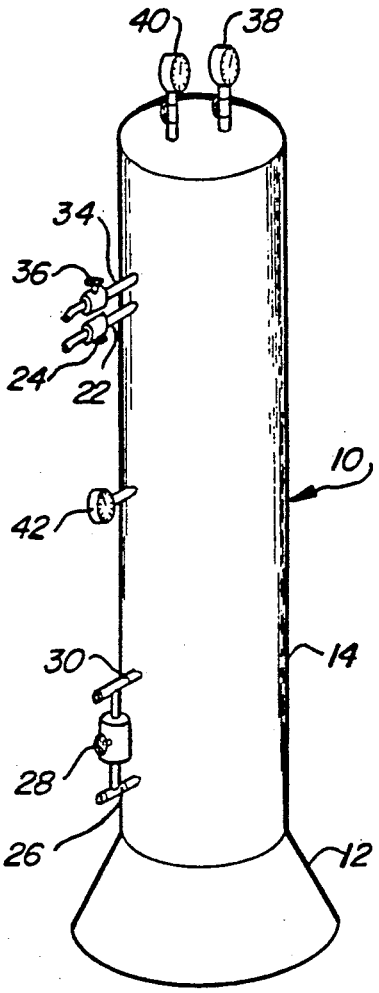
FIG. 1 is a perspective view of the passive refrigerant retrieval and storage apparatus of the present invention.
Figure 2:
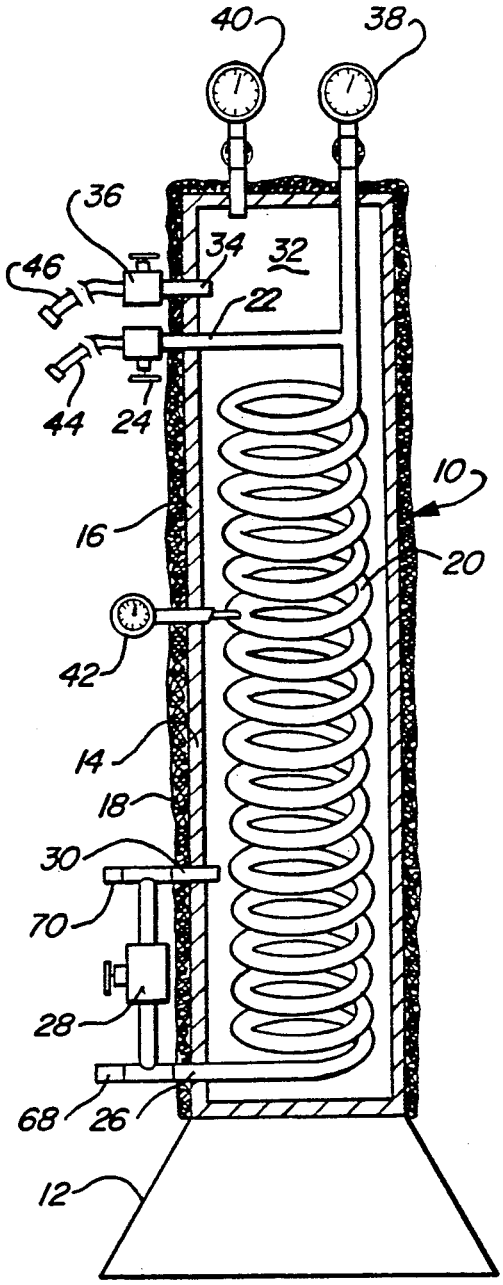
FIG. 2 is a elevational sectional view of the apparatus of FIG. 1 showing the interior components and FIG. 3 is a schematic view of a typical cooling system.

The refrigerant retrieval and storage apparatus of the present invention is shown in FIGS. 1 and 2 and designated generally at 10. Apparatus 10 includes a base 12 supporting a generally vertical housing 14. Housing 14 consists of a tube 16 surrounded by insulation 18.

Housing 14 contains a coiled collector tube 20 vertically oriented within the housing. The tube 20 has an inlet 22 which extends through the housing to an inlet valve 24. The lower end of the collector tube passes through the housing 14, forming an outlet 26. Outlet 26 is connected to an adjustable metering valve 28 leading to a tube 30 that passes back through the wall of housing 14 to the housing interior 32. The housing 14 includes an outlet 34 with a valve 36 near the upper end of the housing.

Figure 3:
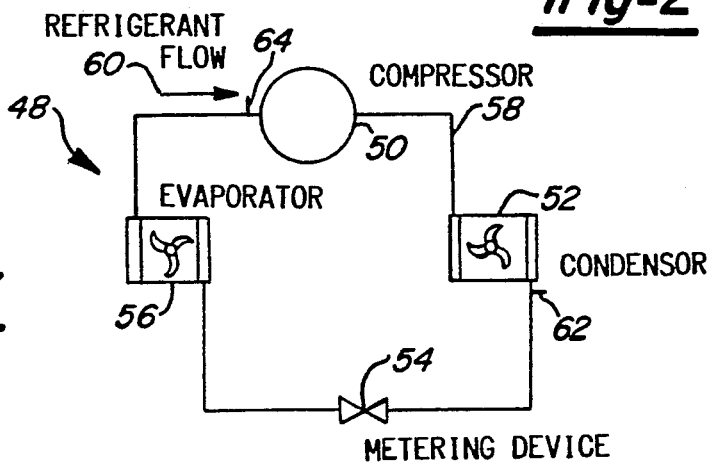

A pressure gauge 38 is connected to the collector tube 20 to monitor the pressure within the tube while a pressure gauge 40 monitors the pressure within the interior 32 of housing 14. A thermometer 42 is coupled to collector tube 20 to monitor the temperature inside the tube and the coolant therein. Flexible inlet hose 44 coupled to the inlet valve 24 and flexible outlet hose 46 coupled to outlet valve 36 are used to connect the apparatus 10 to the normal service access ports of a cooling system such as the cooling system 48 shown in FIG. 3.

Cooling system 48 includes a compressor 50, condenser 52, metering device 54 and evaporator 56 connected to one another as shown by appropriate tubing 58 through which a refrigerant flows in the direction of arrow 60. Such cooling systems typically contain an access port 62 immediately following the condenser 52 as well as an access port 64 at the inlet side of the compressor 50.

Retrieval and storage apparatus 10 is coupled to the cooling system 48 to retrieve refrigerant therefrom prior to servicing the cooling system 48 by connecting the inlet hose 44 to access port 62 and the outlet hose 46 to the access port 64. Retrieval of refrigerant begins with the inlet valve 24 and outlet valve 26 open and the adjustable metering valve 28 closed. The compressor 50 of the cooling system is activated, compressing refrigerant gas which is then condensed in condenser 52. Since the internal pressure in collector tube 20 is initially low, a portion of the condensed pressurized refrigerant will flow through the access port 62 into the collector tube rather than flowing through the restricted flow metering device 54. As liquid refrigerant collects in tube 20, the metering valve 28 is slowly opened to allow a portion of the refrigerant to flow from the collector tube 20 into the relatively low pressure housing 14 interior where a small portion of liquid refrigerant flashes and is evaporated in the housing 14. As this refrigerant evaporates, the liquid refrigerant passing through collector tube 20 is cooled.

The evaporated refrigerant in housing 14 is drawn through the outlet 34 into the suction or inlet port 64 of the compressor 50. Initially, the pressure within the collector tube 20 approaches the normal high side operating pressure of the cooling system. However, as more and more refrigerant collects in the housing 14, the amount of evaporated refrigerant in the cooling system decreases such that the compressor outlet and inlet pressures begin to fall. As this occurs, the pressure in collector tube 20 also drops. In response to the gradually dropping pressure within tube 20, the adjustable metering valve 28 is gradually opened to allow more coolant to flow from the tube 20 into housing 14 where it is evaporated. As the cooling system 48 is gradually starved for refrigerant, the pressures in the system gradually decrease as does the temperature of the refrigerant in the collector tube 20. Eventually most, but not all, of the refrigerant will be contained within the housing 14 in liquid form.

The retrieval and storage apparatus is referred to as a passive apparatus in that it does not necessarily include its own compressor to draw refrigerant from the cooling system but rather utilizes the stored energy in the refrigerant created by the cooling system compressor, an environment that traps the refrigerant outside of the cooling system 48. Only a small percentage of cooling system repairs involve the compressor such that in most instances, the cooling system compressor is available for use in retrieving the refrigerant. Alternatively, however, a separate compressor (not shown) could be used with system 10 where the compressor 50 of the system 40 being serviced is not functioning.

The retrieval and storage apparatus 10 can retrieve over 90 percent of the refrigerant from the cooling system 48. After disconnecting the retrieval apparatus 10 from the cooling system, the remaining coolant can be collected in a balloon or like device or discharged to the atmosphere. The apparatus 10 is a relatively simple structure not including a compressor or other mechanical devices as commonly found in the active refrigerant retrieval systems currently available. As a result, the retrieval apparatus 10 is significantly lower in cost. The lower costs will make it more economical for many repairment to use such that more refrigerant will be retrieved as compared to current practice.

Once the refrigerant from the cooling system has been retrieved in apparatus 10, it may be reused after the repair or the apparatus can be taken to a refrigerant processing facility where the refrigerant is removed from the apparatus 10 and processed for reuse. The process of refrigerant recovery from apparatus 10 is expedited due to the tall cylindrical shape of housing 14 which can be tipped to a horizontal position causing the exposed surface area of the collected liquid refrigerant for heat exchange to be dramatically increased as compared with housing 14 in a vertical orientation. Apparatus 10 includes an access port 68 at the outlet 26 of tube 20 and an access port 70 at tube 30 for use in removing refrigerant from collector tube 20 and housing 14.

It is to be understood that the invention is not limited to the exact construction or method illustrated and described above, but that various changes and modifications may be made without departing from the spirit and scope of the invention as defined in the following claims.

I claim:

1. An apparatus for retrieval and storage of refrigerant from a cooling system having a low pressure side and a high pressure side, said apparatus comprising:

a collector vessel and means for connecting said vessel to the high pressure side of said cooling system to receive refrigerant from the cooling system;

a housing in heat exchange relationship with said collector vessel;

means for discharging a portion of said refrigerant from said collector vessel through a metering device into the interior of said housing where the refrigerant vaporizes and cools the refrigerant in said collector vessel; and means for connecting said housing interior to said low pressure side of the cooling system to return evaporated refrigerant to said cooling system.

2. The apparatus of claim 1 wherein said collector vessel comprises a tube coiled within said housing.

3. The apparatus of claim 1 wherein said metering device is adjustable.

4. The apparatus of claim further comprising a first pressure gage for monitoring the pressure within said collector vessel and a second pressure gauge for monitoring the pressure within said housing.

5. The apparatus of claim 1 further comprising at least one flexible tube for connecting said apparatus to the cooling system.

6. The apparatus claim 1 wherein the exterior of said housing is insulated.

7. The apparatus of claim 1 wherein said means for connecting said collection vessel to said high pressure side of said cooling system includes a first valve means for controlling the flow of refrigerant and said means for connecting said housing interior to said low pressure side of said cooling system includes a second valve means for controlling the flow of refrigerant whereby said first and second valves enable said apparatus to be removably connected to and isolated from said cooling system.

8. The apparatus of claim 1 wherein said collector vessel comprises an elongated cylinder with means for maintaining said cylinder in a vertically oriented position during use.

9. An apparatus for retrieval and storage of refrigerant from a cooling system being serviced of the type having a compressor for circulating a compressible refrigerant in a closed, pressurized system between a condenser on the high pressure side of said system and an evaporator on the low pressure side of said system to provide a cooling effect, comprising:

a housing;

a collector vessel disposed within said housing having an inlet and an outlet;

first means for connecting said collector vessel inlet with the cooling system high pressure side for receiving pressurized refrigerant from the cooling system;

a first valve means for controlling the flow of refrigerant through said first means for connecting, metering means coupled to the outlet of said collector vessel for discharging a portion of the refrigerant from said collector vessel into the interior of said housing whereby the refrigerant vaporizes in said housing;

outlet means for venting the vaporized refrigerant from said housing adjacent the upper end of said housing;

second means for connecting said outlet means to the low pressure side of said cooling system whereby vaporized refrigerant is drawn from said housing into the compressor; and a second valve means for controlling the flow of refrigerant through said second means for connecting wherein said first and second valve means enable said apparatus to be removably connected to and isolated from said cooling system.

10. The apparatus of claim 9 wherein said metering means is adjustable to vary the flow of refrigerant from said collector vessel into said housing.

11. The apparatus of claim 9 wherein said collector vessel comprises a tube coiled within said housing.

12. The apparatus of claim 9 further comprising a first pressure gauge for monitoring the pressure within said collector vessel.

13. The apparatus of claim 10 wherein said first and second means for connecting include a flexible tube between the cooling system and said apparatus.

14. The apparatus of claim 9 wherein the exterior of said housing is insulated.

15. A method of retrieving and storing refrigerant from a cooling system being serviced of the type having a compressor for circulating a compressible refrigerant in a closed, pressurized system between a condenser and an evaporator to provide a cooling effect, the method comprising the steps of:

connecting one end of a refrigerant collector tube contained within a housing to the cooling system at the condenser outlet;

connecting the interior of said housing to the compressor inlet;

operating the cooling system compressor to pressurize refrigerant in the cooling system and pump the refrigerant into said collector tube; and discharging refrigerant from said collector tube into said housing interior through a metering valve where the refrigerant pressure is reduced and evaporates and cools the refrigerant remaining in said tube and the evaporated refrigerant is drawn into said compressor inlet whereby said refrigerant becomes trapped within said housing.

16. An apparatus for retrieval and storage of refrigerant from a cooling system being serviced of the type having a compressor for circulating a compressible refrigerant in a closed, pressurized system between a condenser on the high pressure side of the system and an evaporator on the low pressure side of the system to provide a cooling effect, comprising:

a housing in the form of a vertically oriented elongated cylinder, a coiled collector tube disposed within said housing and having an inlet and an outlet, a first flexible hose connecting said collector tube inlet with the cooling system high pressure side for receiving pressurized refrigerant from the cooling system, a first valve means mounted to said housing for controlling the flow of refrigerant through said first flexible hose and for isolating said collector tube from the cooling system enabling said first hose to be removably connected to the cooling system, metering means coupled to the outlet of said collector tube for discharging a portion of the refrigerant from said collector tube into the interior of said housing whereby the refrigerant vaporizes in said housing;

outlet means for venting the vaporized refrigerant from said housing adjacent the upper end of said housing;

a second flexible hose connecting said outlet means to the cooling system low pressure side for returning refrigerant to the cooling system, and second valve means mounted to said housing for controlling the flow of refrigerant through said second flexible hose and for isolating said housing from the cooling system enabling said second hose to be removably connected to said system.

* * * * *

UNITED STATES PATENT AND TRADEMARK OFFICE

CERTIFICATE OF CORRECTION

PATENT NO. : 5,072,594

DATED : December 17, 1991

INVENTOR(S) : David C. Squires

It is certified that error appears in the above-identified patent and that said Letters Patent is hereby corrected as shown below:

Title page: Item [76] Under "Inventor:", "Squire" should read --Squires--.
Column 5, Line 3, Claim 4, after "claim" insert --1--.

Signed and Sealed this

Fifth Day of October, 1993

*Attest:*

Bruce Lehman

BRUCE LEHMAN

*Attesting Officer*

*Commissioner of Patents and Trademarks*